United States Patent [19]

Lehmann et al.

[11] 3,968,398

[45] July 6, 1976

[54] FUSED DECORATIVE STRING SET

[75] Inventors: Louis E. Lehmann, Geneva; Ralph J. Luft, Aurora, both of Ohio

[73] Assignee: General Electric Company, Schenectady, N.Y.

[22] Filed: Jan. 3, 1975

[21] Appl. No.: 538,402

Related U.S. Application Data

[63] Continuation of Ser. No. 397,957, Sept. 17, 1973, abandoned.

[52] U.S. Cl. ..... 315/185 S; 315/122; 240/10 T

[51] Int. Cl.[2] ..... H05B 37/03

[58] Field of Search ..... 315/122, 185 S, 185 R; 240/10 T

[56] References Cited

UNITED STATES PATENTS

| | | | |
|---|---|---|---|
| 783,876 | 2/1905 | Lindall | 315/122 |
| 1,974,472 | 9/1934 | Seghers | 315/185 S |
| 2,272,523 | 2/1942 | Inman | 315/122 X |

FOREIGN PATENTS OR APPLICATIONS

| | | | |
|---|---|---|---|
| 817,929 | 8/1959 | United Kingdom | 315/185 R |
| 419,631 | 11/1934 | United Kingdom | |

OTHER PUBLICATIONS

Reference Data for Radio Engineers, 5th ed. Copyright 1968 Howard W. Sams & Co. Inc. pp. 4–54, 55 & 58.

*Primary Examiner*—John S. Heyman
*Attorney, Agent, or Firm*—Paul F. Wille; Lawrence R. Kempton; Frank L. Neuhauser

[57] ABSTRACT

A string set, of the type used on Christmas trees, of series-connected incandescent lamps where two lamps nearest the string set plug are unshunted and are connected to the plug through a wire of a gauge larger than the wire connecting the remaining lamps in the set. The unshunted lamps and the larger wire serve as a fuse for the entire set.

8 Claims, 7 Drawing Figures

FUSED DECORATIVE STRING SET

This is a continuation of application Ser. No. 397,957, filed Sept. 17, 1973.

BACKGROUND OF THE INVENTION

1. Field of the Invention

The invention relates generally to string sets of series-connected, decorative, incandescent lamps. More particularly, the invention relates to a string set construction wherein two unshunted lamps and the two wires connecting the lamps to a plug act as a fuse for the string set.

2. Description of the Prior Art

In the past, most string sets of series-connected decorative incandescent lamps have been made of either 18-gauge wire for outdoor use or 20-gauge wire for indoor use. Unfused string sets made of smaller conductor wires would not be protected by the conventional 15- and 20-ampere branch circuit fuses and circuit breakers. In other words, if an unfused indoor string set with a wire size smaller than 20 gauge encountered an electrical problem, the 15-or 20-ampere fuse or breaker would not open the circuit. This is so because the current flowing through the smaller diameter conductor would not be sufficient to trip the circuit breaker or blow the fuse even when there is a problem in the set. Accordingly, the heat buildup in the string set of the smaller gauge wire would continue to a point where it might ignite the string set insulation or anything in the surrounding area before any fuse would blow or breaker trip.

Although the economies of using string sets of smaller gauge wire are great, they should not be used without short circuit protection. Any short circuit protection designed into a string set should have the qualities of being able to utilize standard parts such as lamp sockets, wires and insulation which are presently used in the string set industry. Furthermore, any short circuit protective device should also have the quality of being able to blend in with all the other lamps and sockets of the string set inasmuch as these sets are primarily used for decorative purposes.

SUMMARY OF THE INVENTION

It is therefore an object of the invention to provide a decorative string set using wire sizes smaller than those used in sets of the prior art. A further object of the invention is to provide a string set having smaller wire diameter conductors and a short circuit protective device which renders the string set safe in the event of electrical malfunction. Yet another object of the invention is to provide such a string set utilizing standard parts of the prior art. Still another object of the invention is to provide a fuse or circuit protective device for the string set which does not detract from the aesthetic beauty of the decorative string set.

The objects of the invention are accomplished by providing a string set having all but two lamps-sockets connected by a smaller gauge wire, such as 24-gauge insulated wire. The two lamps-sockets nearest the plug end of the string set are connected to the plug by a heavier gauge wire, such as 20-gauge wire. The lamps fitting the last two sockets are unshunted incandescent filament lamps which, unlike the shunted variety in the remainder of the string set, will form an open circuit upon filament failure. Adequate protection for both sides of the series string set is provided by positioning the two unshunted incandescent lamps as the first and last lamps in the set and by connecting them to the plug with a heavier gauge wire. In the event of any electrical problems within the string set, either or both of the unshunted lamps would pass a current through the filament which would be sufficiently high to burn out the filament and accordingly open the circuit and prevent any further difficulties from arising due to overheating and possible fire.

Additionally, the two sockets are made such that they will accept only the special unshunted lamps. This can be accomplished in several ways, one is that the shunted lamps have a smaller diameter, and the second is that they have a curved keyed surface which will not mate with the larger flat keyed surface of the socket. Since the fuse device is in effect two slightly larger sockets and two pieces of wire of somewhat larger diameter, the string set's decorative appearance is not marred because these portions which form the fuse blend in with the remaining portions of the string set.

DESCRIPTION OF THE PREFERRED EMBODIMENTS

Figure 1:
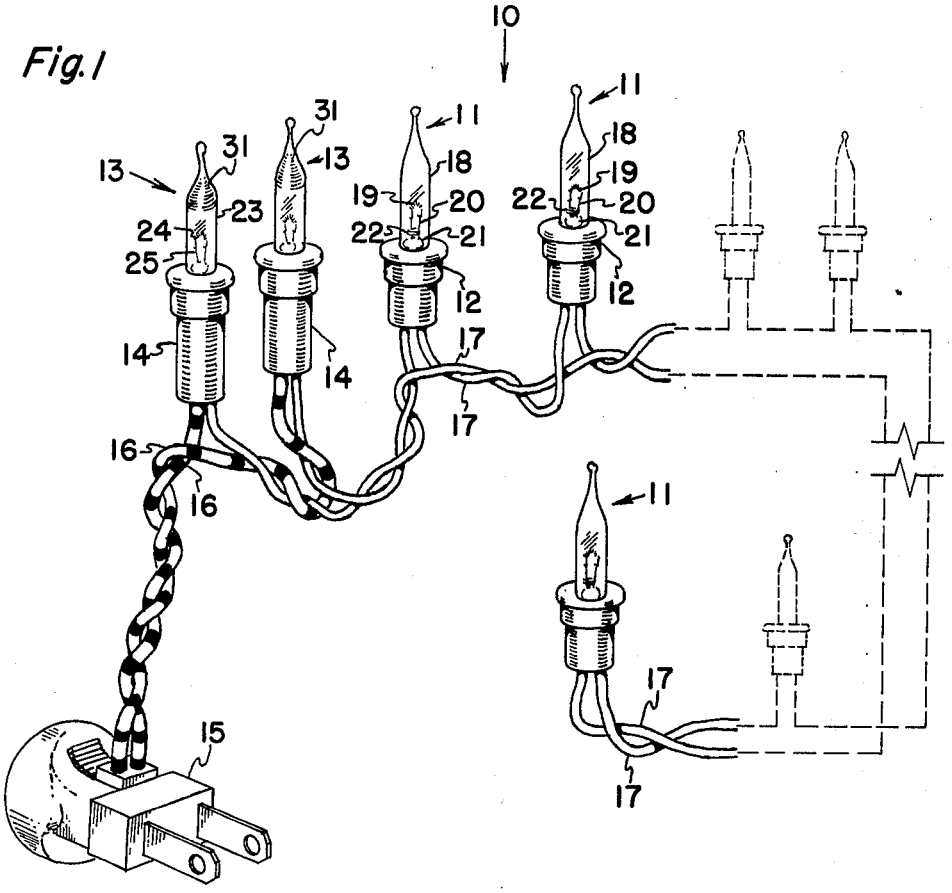
FIG. 1 is a perspective view showing the string set of the invention.

Referring now to FIG. 1 of the drawings, a string set 10 is therein illustrated and is comprised of shunted lamps 11 which fit in regular sockets 12 and unshunted lamps 13 which fit in special sockets 14. Plug 15 is connected to special sockets 14 through heavier gauge wire indicated by the number 16. The remaining regular sockets 12 are connected by a wire of slightly smaller diameter indicated by the number 17. This smaller diameter wire can be seen coming out of one side of special sockets 14 and into the other side of regular lamp sockets 12. The set 10 is shown with the conductors twisted together to form a straight line. They may also be unwound to form the conventional loop or circle.

Figure 5:
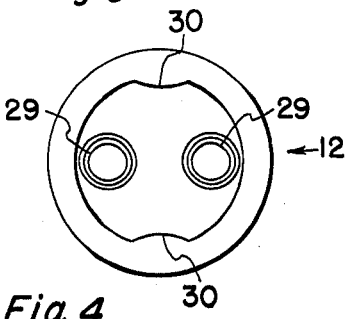
FIG. 5 is a top elevation view of the socket shown in FIG. 4.
Figure 7:
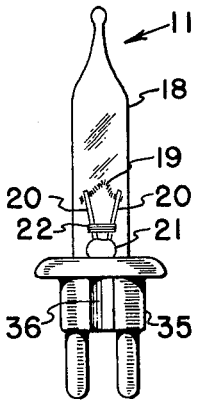
FIG. 7 is a front elevation view of a regular lamp used in the string set of the invention.

Shunted lamps 11 (FIGS. 1 and 7) are comprised of an envelope 18, filament 19 connected to lead wires 20 which are held together by bead 21. Just above the bead 21 is a piece of aluminum wire which is wound around the lead wires 20 and is known as a shunt wire. Typically, this shunt wire, 22, serves the purpose of maintaining the string set in a closed circuit position upon the failure of filament 19. Shunt wire 22 is of a thickness sufficiently large such that it will not glow like a filament; however, it will continue to conduct and maintain the string set circuit in an operative condition. As shown in FIG. 7, lamp 11 has a base 35 which contains a groove 36 and fits socket 12 mating snugly with extension 30, FIG. 5.

Figure 6:
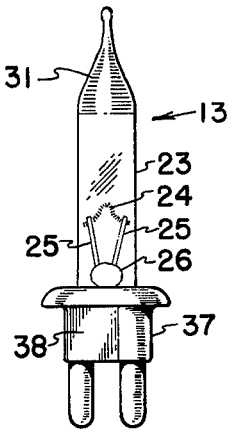
FIG. 6 is a front elevation view of a special lamp.

Unshunted lamp 13 (FIGS. 1 and 6) is similarly comprised of envelope 23, filament 24 connected to lead wires 25 and held together by bead 26. However, unlike lamp 11, lamp 13 does not contain a shunt wire so that when the filament of lamp 13 fails the circuit will break and be in an open circuit position. Unshunted lamp 13 has a base 37 with a flat 38 to fit socket 14 by mating with extension 28 shown in FIG. 3.

Figure 3:
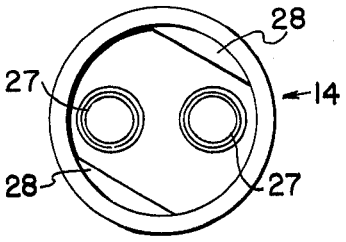
FIG. 3 is a plan view of the socket.
Figure 2:
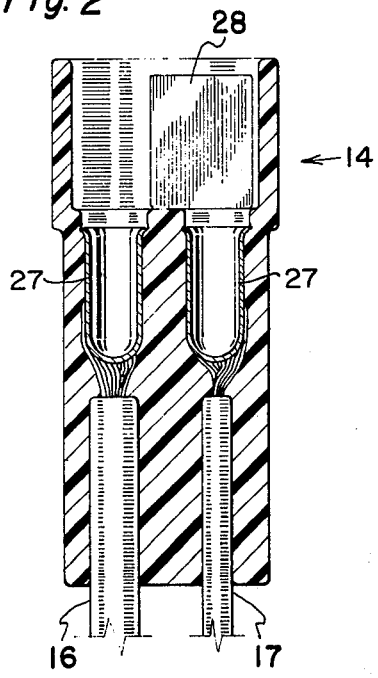
FIG. 2 is a front elevation view in section of the special socket of the string set.
Figure 4:
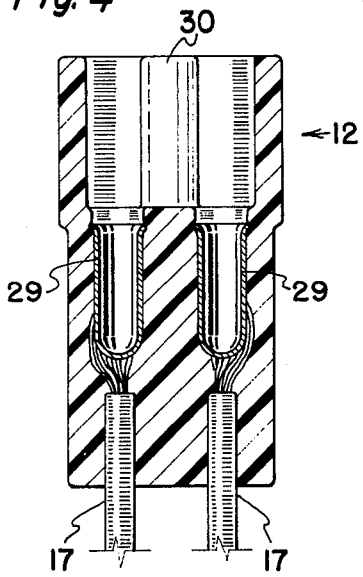
FIG. 4 is a front elevation section view of the socket used throughout the remainder of the string set.

FIGS. 2 and 3 are a front elevation section view and a plan view, respectively, of special socket 14. Heavier gauge conductor 16 enters one side of the socket and lighter gauge conductor 17 makes contact on the other side of the socket. If shunted lamp 11 were placed in special socket 14, it would not accomplish the purpose of serving as a fuse for one side of the string set in that when filament 19 of lamp 11 failed shunt wire 22 would continue to conduct current to the string set in spite of any electrical problems existing in the set. It is therefore important to make the lamp and socket combination such that shunted lamp 11 will not be usable in special socket 14. Accordingly, socket 14 has been designed to accept a special lamp 13. Special socket 14 has extensions 28 which match a flat 38 on unshunted lamps 13. By comparison, socket 12 has smaller diameter contact openings 29 and has a somewhat circular extension 30 to mate with groove 36 both of which are of a different shape and are smaller than the extension 28 and flat 38 of socket 14 and lamp 13.

Another aid in placing the proper lamp in the special socket is by color coding unshunted lamps 13 with a green safety color as illustrated at 31. Not all of these precautions are necessary in combination in that one or more may work to prevent incorrect insertion into the special socket in and of themselves.

One particular example of a string set which will utilize the invention is one using a 20-gauge diameter conductor inside the wire illustrated by 16 and a 24-gauge conductor similarly illustrated by the wire marked at 17. These conductors have a PVC thermoplastic insulation which is generally between 16 and 23 mils in thickness. In the set of this example, unshunted lamps 13 are painted green such as indicated at 31 and also have in their base portion a slot which fits snugly with extension 28 in socket 14. This embodiment does not utilize the third alternative of making socket 14 and lamp 13 with contacts which would fit at 27 but would be too large for 29 and vice versa. In other words, unshunted lamp 13 may fit in socket 12; however, because of extension 28, the shunted lamp 11 would not be accepted by special socket 14.

The fuse mechanism works in either of two ways. First, larger size conductor 16 can conduct a higher current than smaller conductor 17 when there is a problem in the circuit thereby conducting a current which would trip a conventional 15- or 20-amp circuit breaker or blow a 15- or 20-amp fuse. The unshunted lamps and heavier gauge wire work in yet a second way to protect the string set circuit in that filament 24 is designed such that any excess in current above a safe level will burn out or break the filament. Since the lamp 13 is unshunted, the circuit will be in an open circuit condition and will not be conducting electricity to any trouble spot in the series set.

What I claim as new and desire to secure by Letters Patent of the United States is:

1. A string set of series-connected incandescent lamps comprising:

a plurality of lamps in a plurality of lamp sockets;

first conductor means interconnecting said sockets to form a string of series-connected sockets between two end sockets;

second conductor means connecting said end sockets to a plug;

said second conductor means having higher current capacity than said first condutor means; and the lamps in at least the end sockets are the unshunted type and the remainder of said plurality of lamps are shunted lamps, whereby excessive current causes at least one of said unshunted end lamps to open-circuit to prevent overheating in the circuit formed with said first conductor means.

2. The string set as set forth in claim 1 wherein said first conductor means comprises 24-gauge wire and said second conductor means comprises 20-gauge wire.

3. The string set as set forth in claim 1 wherein said first and second conducting means form a closed loop terminated at said plug.

4. The string set as set forth in claim 1 wherein said loop is twisted to form a straight line string set.

5. The string set as set forth in claim 1 wherein said unshunted lamps and said end sockets have different male and female parts from shunted lamps and the sockets of the remainder of the string set, respectively; said different parts preventing the insertion of shunted lamps into said end sockets.

6. The string set as set forth in claim 5 wherein said end lamps and sockets have male and female parts of different dimensions from shunted lamps and the sockets, respectively, of the rest of the string set.

7. The string set as set forth in claim 5 wherein said different parts permit the insertion of unshuntd lamps in the remainder of said string set.

8. The string set as set forth in claim 7 wherein the unshunted lamps comprise a base having a flat, and said end sockets comprise a hollow portion having a shoulder for engaging said flat and for preventing shunted lamps from being inserted into said end socket.

* * * * *